US011296453B2

(12) United States Patent
Komori et al.

(10) Patent No.: US 11,296,453 B2
(45) Date of Patent: Apr. 5, 2022

(54) WATERPROOF STRUCTURE OF CONNECTOR

(71) Applicants: AutoNetworks Technologies, Ltd., Yokkaichi (JP); Sumitomo Wiring Systems, Ltd., Yokkaichi (JP); SUMITOMO ELECTRIC INDUSTRIES, LTD., Osaka (JP); TOYOTA JIDOSHA KABUSHIKI KAISHA, Toyota (JP)

(72) Inventors: Hirokazu Komori, Yokkaichi (JP); Yusuke Nakagawa, Toyota (JP)

(73) Assignees: AutoNetworks Technologies, Ltd.; Sumitomo Wiring Systems, Ltd.; Sumitomo Electric Industries, Ltd.; Toyota Jidosha Kabushiki Kaisha

( * ) Notice: Subject to any disclaimer, the term of this patent is extended or adjusted under 35 U.S.C. 154(b) by 246 days.

(21) Appl. No.: 16/492,720

(22) PCT Filed: Feb. 23, 2018

(86) PCT No.: PCT/JP2018/006657
§ 371 (c)(1),
(2) Date: Sep. 10, 2019

(87) PCT Pub. No.: WO2018/168394
PCT Pub. Date: Sep. 20, 2018

(65) Prior Publication Data

US 2021/0296814 A1 Sep. 23, 2021

(30) Foreign Application Priority Data

Mar. 14, 2017 (JP) ..... JP2017-048357

(51) Int. Cl.
*H01R 13/40* (2006.01)
*H01R 13/52* (2006.01)
*H01R 13/523* (2006.01)

(52) U.S. Cl.
CPC ..... *H01R 13/5205* (2013.01); *H01R 13/523* (2013.01); *H01R 13/5213* (2013.01)

(58) Field of Classification Search
CPC ..... H01R 13/5205; H01R 13/5213; H01R 13/523
(Continued)

(56) References Cited

U.S. PATENT DOCUMENTS 5,437,563 A 8/1995 Kihira et al.
5,542,856 A * 8/1996 Wood ..... H01R 13/523 439/281
(Continued)

FOREIGN PATENT DOCUMENTS

JP 47-35782 11/1972
JP 59-170975 11/1984
(Continued)

OTHER PUBLICATIONS

International Search Report dated Mar. 27, 2018.

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

A waterproof structure of a connector 1 is configured to waterproof a cable 40 including a sheath 41 surrounding a plurality of wires 42, and a connector housing 10 connected to the plurality of wires 42 extending from a tip portion 41E of the sheath 41. The waterproof structure includes a seal member 50 collectively covering the plurality of wires 42 between the cable 40 and the connector housing 10. The seal
(Continued)

member 50 has one end fitted onto the sheath 41 and in which the plurality of wires 42 extend from the tip portion 41E with any arrangement relation, and another end fitted into the connector housing 10.

13 Claims, 11 Drawing Sheets

(58) Field of Classification Search
USPC ..... 439/587
See application file for complete search history.

(56) References Cited

U.S. PATENT DOCUMENTS 5,720,487 A * 2/1998 Kato ..... H01R 13/5205 277/637
5,820,395 A * 10/1998 Hashizawa ..... H01R 13/5221 439/271
6,602,090 B2 * 8/2003 Kato ..... H01R 13/5205 439/455
7,507,125 B2 * 3/2009 Okamura ..... H01R 13/506 439/680
8,118,614 B2 * 2/2012 Sawada ..... H01R 13/5202 439/589
8,727,799 B2 * 5/2014 Osawa ..... H01R 13/5208 439/275
10,298,004 B2 * 5/2019 Komori ..... H02G 15/013
2013/0105219 A1 5/2013 Osawa et al.

FOREIGN PATENT DOCUMENTS

JP 5-258801 10/1993
JP 2013-97898 5/2013
JP 2016-122524 7/2016
JP 2016-194976 11/2016

* cited by examiner

WATERPROOF STRUCTURE OF CONNECTOR

BACKGROUND

Field of the Invention

The present invention relates to a waterproof structure of a connector attached to a tip of a wire conductive portion.

Related Art

As a waterproof structure of a connector in which a plurality of wires are led into and connected to a housing, a technology disclosed in Japanese Unexamined Patent Application Publication No. 2013-97898 has been known. In this technology, in order to prevent an intrusion of water or the like into an outer sheath in which the plurality of wires are bundled together, a rubber plug is fitted onto a tip (a led-out portion of the wires) of the outer sheath and the wires are individually inserted through a plurality of through holes provided in the rubber plug in a predetermined posture (at a predetermined angle), respectively, thereby stopping an opening (a gap between each wire and the outer sheath) of the tip of the outer sheath.

However, in this configuration, in a case where an inserted wire deviates from the predetermined posture (angle), a shape followability of the rubber plug is insufficient and thus a gap may be generated between the wire and the rubber plug to impair a waterproof performance.

Therefore, in a case where a bent portion is provided in the wire in the connector (for example, the wire is bent at about 45 degrees as in Japanese Unexamined Patent Application Publication No. 2013-97898), a length dimension from the bent portion to the rubber plug needs to be secured, such that the bent portion does not affect an angle at which the wire is inserted into the rubber plug. For this reason, in a case where, particularly, a wire with a relatively large diameter is bent in the connector, it is difficult to decrease the length dimension. Furthermore, since a rubber is interposed between the respective wires, it is difficult to implement a small diameter of the rubber plug and even a small diameter of the connector.

The technology disclosed in the present description has been completed based on the fact described above, and an object of the technology is to provide a structure of a connector housing for a multicore cable, which can guarantee a waterproof performance and have a small size.

SUMMARY

The technology disclosed in the present description is a waterproof structure of a connector, the waterproof structure configured to waterproof a multicore cable including an outer sheath surrounding a plurality of wires, and a connector main body connected to the plurality of wires extending from a tip portion of the outer sheath, the waterproof structure including: a waterproof member collectively covering the plurality of wires between the multicore cable and the connector main body. The waterproof member has one end fitted onto the outer sheath and in which the plurality of wires extend from the tip portion with any arrangement relation, and another end fitted into the connector main body.

According to the configuration described above, since the waterproof member collectively waterproofs an area from the connector main body to the outer sheath of the cable, a waterproof member stopping an opening of a tip of the outer sheath is unnecessary and it is thus possible to decrease a length dimension of the connector. Furthermore, since there is no need to interpose the waterproof member between the wires, it is possible to decrease a diameter of the connector. In addition, since there is no need to deform each wire extending from the outer sheath of the multicore cable into a predetermined shape (arrangement relation) and it is only required that the wires extend into the waterproof member as it is, operability is excellent.

The waterproof structure of a connector may include: a hard cover member disposed to surround the waterproof member; and a cable fitting portion provided at the one end of the waterproof member. In the cable fitting portion, a cable seal lip portion fitted onto the outer sheath may be circumferentially provided on an inner circumferential surface of the cable fitting portion and an auxiliary cable seal portion fitted into the cover member may be circumferentially provided on an outer circumferential surface of the cable fitting portion, the cable seal lip portion and the auxiliary cable seal portion being disposed at a same position in an axial direction of the cable fitting portion.

According to the configuration described above, since it is possible to correct the shapes of the cable and the waterproof member to desired shapes and fix the desired shapes only by putting the hard cover member on the cable and the waterproof member, an influence of bending deformation in other portions can be reduced and a waterproof performance can be improved. Furthermore, the lip portion of the waterproof member follows deformation of the cable, and thus it is possible to further improve the waterproof performance.

The waterproof structure of a connector may further include: an inner cylinder portion provided in the connector main body and into which the plurality of wires are inserted; and a connector fitting portion provided at the other end of the waterproof member. In the connector fitting portion, a connector seal lip portion fitted onto the inner cylinder portion may be circumferentially provided on an inner circumferential surface of the connector fitting portion.

The waterproof structure of a connector may further include an outer cylinder portion provided in the connector main body and disposed to surround the inner cylinder portion. In the connector fitting portion, an auxiliary connector seal portion fitted into the outer cylinder portion may be circumferentially provided on an outer circumferential surface of the connector fitting portion, the connector seal lip portion and the auxiliary connector seal portion being disposed at a same position in an axial direction of the connector fitting portion.

According to the configuration described above, since a stress generated at the connector seal lip portion due to close adherence to the inner cylinder portion and a stress generated at the auxiliary connector seal portion due to close adherence to the outer cylinder portion face each other with the same position on the connector fitting portion interposed therebetween, it is possible to efficiently closely adhere the connector seal lip portion to the inner cylinder portion.

In the waterproof structure of a connector, the plurality of wires may include a power wire and a signal wire thinner than the power wire, and may be bent between the tip of the outer sheath and the connector main body.

The power wire has a relatively large diameter. Therefore, in a case where the power wire is bent between the tip of the outer sheath and the connector main body, the bent portion is liable to affect even the tip of the outer sheath and it is thus difficult to fit a posture (angle) of the wire to the waterproof member at the tip of the outer sheath. However, according to the configuration described above, since the waterproof member collectively waterproofs an area from an outer portion of the outer sheath to the connector main body, it is possible to achieve a proper waterproofing without being affected by the posture (angle) of the wire in the outer sheath.

In the waterproof structure of a connector, the multicore cable may include a braided wire collectively surrounding the plurality of wires in the outer sheath, and the braided wire may extend from the tip of the outer sheath toward the connector main body.

According to the configuration described above, there is no need to stop the opening of the tip of the outer sheath of the cable with the waterproof member. With this arrangement, it is possible to allow the braided wire to extend from the tip of the outer sheath into the waterproof member.

According to the technology disclosed in the present description, it is possible to provide the structure of the connector housing for a multicore cable, which can guarantee a waterproof performance and have a small size.

BRIEF DESCRIPTION OF THE DRAWINGS

FIG. 8 is a perspective view before putting the cover member on.

DETAILED DESCRIPTION

Embodiment 1

Figure 1:
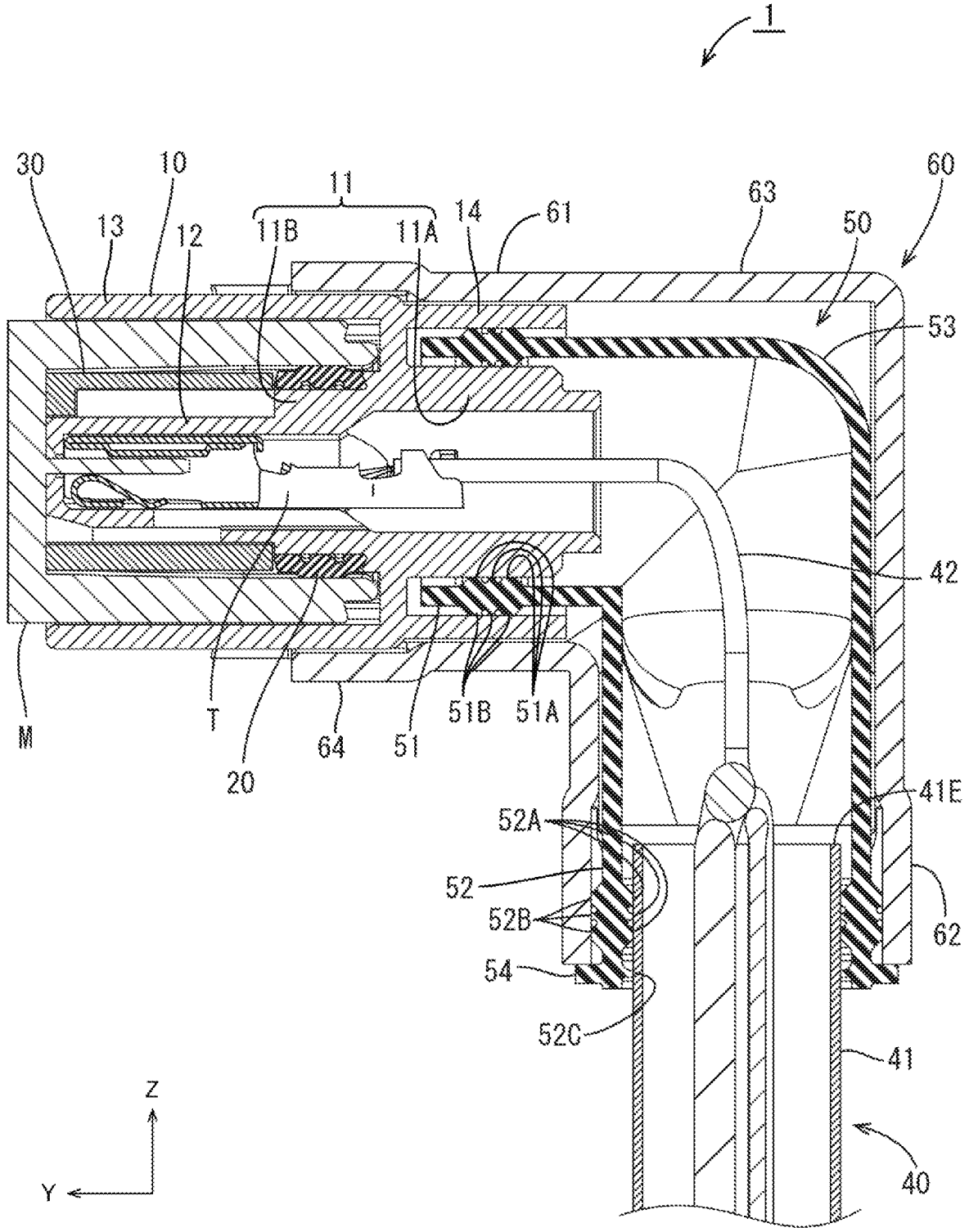
FIG. 1 is a cross-sectional view (cross-sectional view taken along line A-A of FIG. 2) of a waterproof connector according to Embodiment 1.
Figure 2:
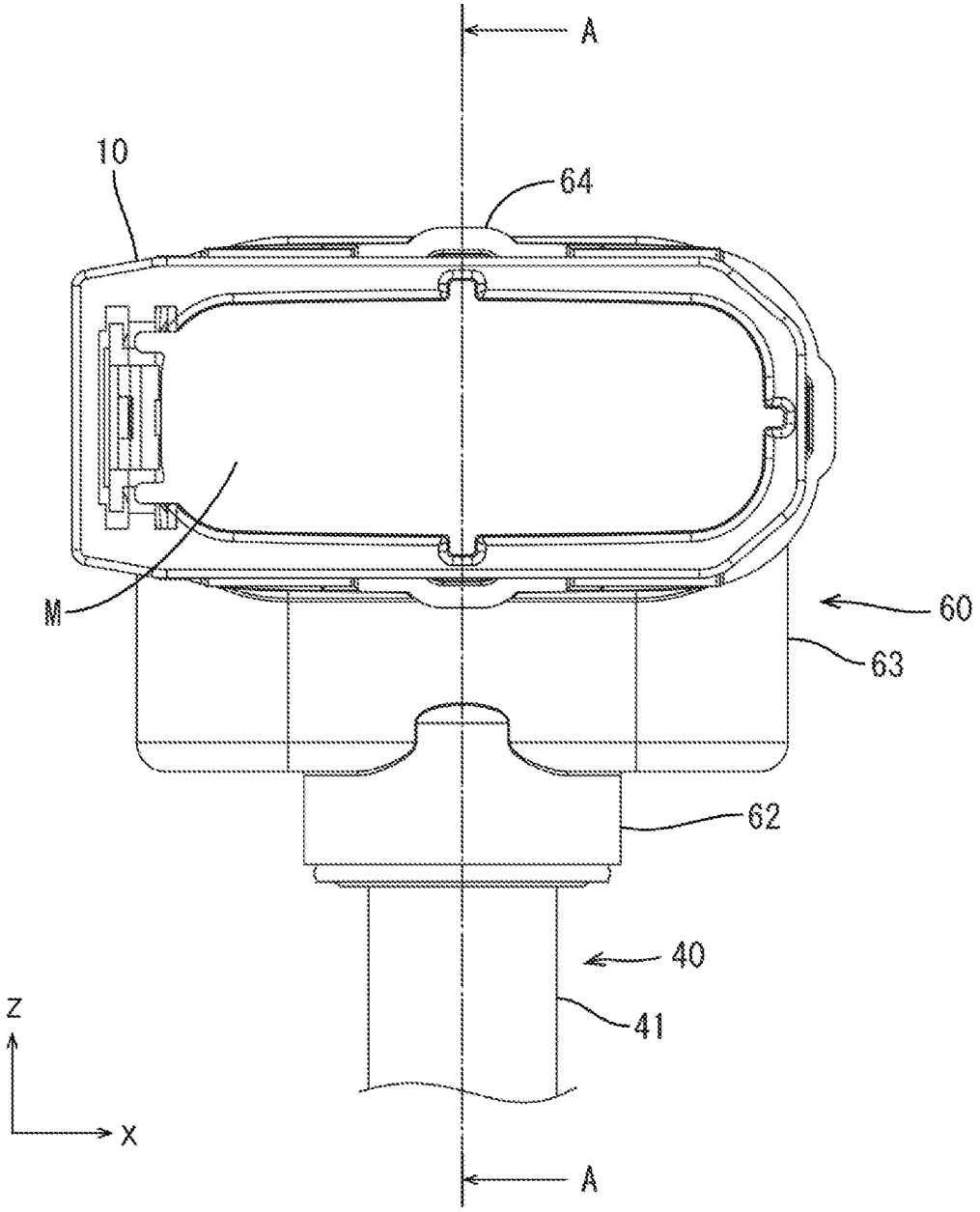
FIG. 2 is a front view of the waterproof connector.

Embodiment 1 of the technology disclosed in the present description will be described with reference to FIGS. 1 to 8. Note that in the following description, an X direction, a Y direction, and a Z direction in the drawings indicate the right side, the front side, and the top side, respectively. Furthermore, in the following description, only one of the same plurality of members has a reference symbol and reference symbols of the others are omitted in some cases.

A connector 1 according to the present embodiment is used by being connected to a tip of a cable 40 (an example of a multicore cable) disposed in a tire house of a vehicle and extending from a power supply in, for example, an electric braking system, and being fitted with a counterpart connector M attached to an electronic control unit (ECU) for controlling braking.

As illustrated in FIG. 1, the connector 1 includes a connector housing 10 (an example of a connector main body), a cable 40 (an example of a multicore cable) in which a wire 42 extending from a tip of a sheath 41 (an example of an outer sheath) is inserted into the connector housing 10, a seal member (an example of a waterproof member) collectively covering from the connector housing 10 to a tip of the sheath 41, and a cover member 60 covering the seal member 50. The seal member 50 and the cover member 60 each have a substantial L-letter shape bent at a substantially right angle when viewed from the side, and the wire 42 is disposed in the seal member 50 and the cover member 60 while being bent at a substantially right angle when viewed from the side.

Figure 4:
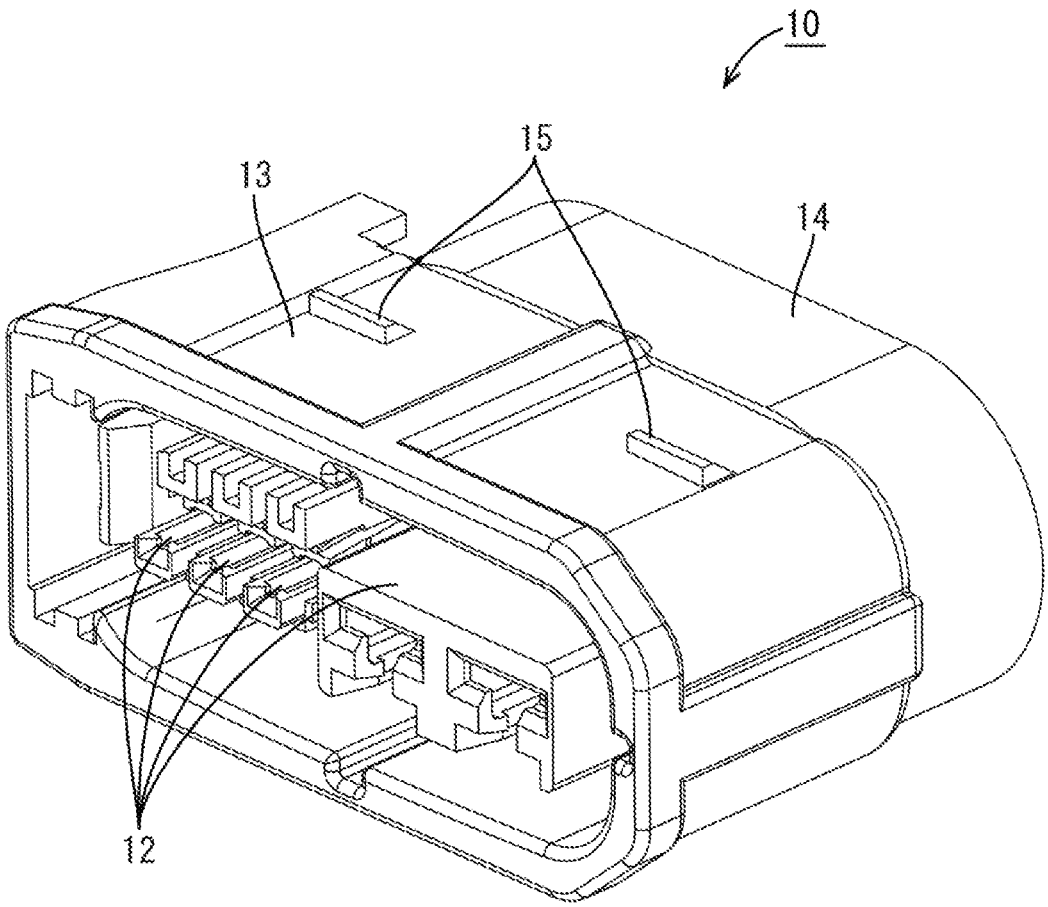
FIG. 4 is a perspective view illustrating a connector housing.

As illustrated in FIGS. 1 and 4, the connector housing 10 integrally includes a wire surrounding portion 11 having a tubular shape and penetrating through the connector housing 10 in a front-rear direction, a hood portion 13 having a substantially rectangular tubular shape and disposed to surround a front end portion 11B of the wire surrounding portion 11, and an outer cylinder portion 14 having an oval cylinder shape and disposed to surround a rear half portion 11A of the wire surrounding portion 11. Note that in the present embodiment, the oval cylinder shape refers to a cylindrical shape of which a lateral cross section has substantially the same oval shape from one end portion to the other end portion. Further, the oval shape includes an elliptical shape.

A seal ring 20 having a ring shape and formed of an elastic material is fitted onto an outer circumferential surface of the front end portion 11B of the wire surrounding portion 11. A plurality of terminal holding portions 12 are disposed in a space surrounded by the hood portion 13 while extending in the front-rear direction. A front retainer 30 is fitted from an opening of the hood portion 13 so as to collectively surround the respective terminal holding portions 12, and is fixed in the connector housing 10 by a locking structure (not illustrated) in a state in which a front end surface of the seal ring 20 faces an opening surface (a rear end surface in FIG. 1) of the front retainer 30. Two locking claws 15 to be locked to lock receiving portions 64A of the cover member 60 to be described later are provided on each of an upper surface and a lower surface of the hood portion 13 while being aligned laterally.

The rear half portion 11A of the wire surrounding portion 11 is an inner cylinder portion 11A which has an oval cylinder shape and onto which the seal member 50 to be described later is fitted. A lateral cross section of an outer circumferential surface of the inner cylinder portion 11A has an oval shape of which an upper portion and a lower portion are flat. A lateral cross section of an inner circumferential surface of the outer cylinder portion 14 described above has an oval shape of which an upper portion and a lower portion are flat, and the inner circumferential surface of the outer cylinder portion 14 is disposed while forming a predetermined gap between the inner circumferential surface of the outer cylinder portion 14 and the outer circumferential surface of the inner cylinder portion 11A over the whole circumference.

Figure 5:
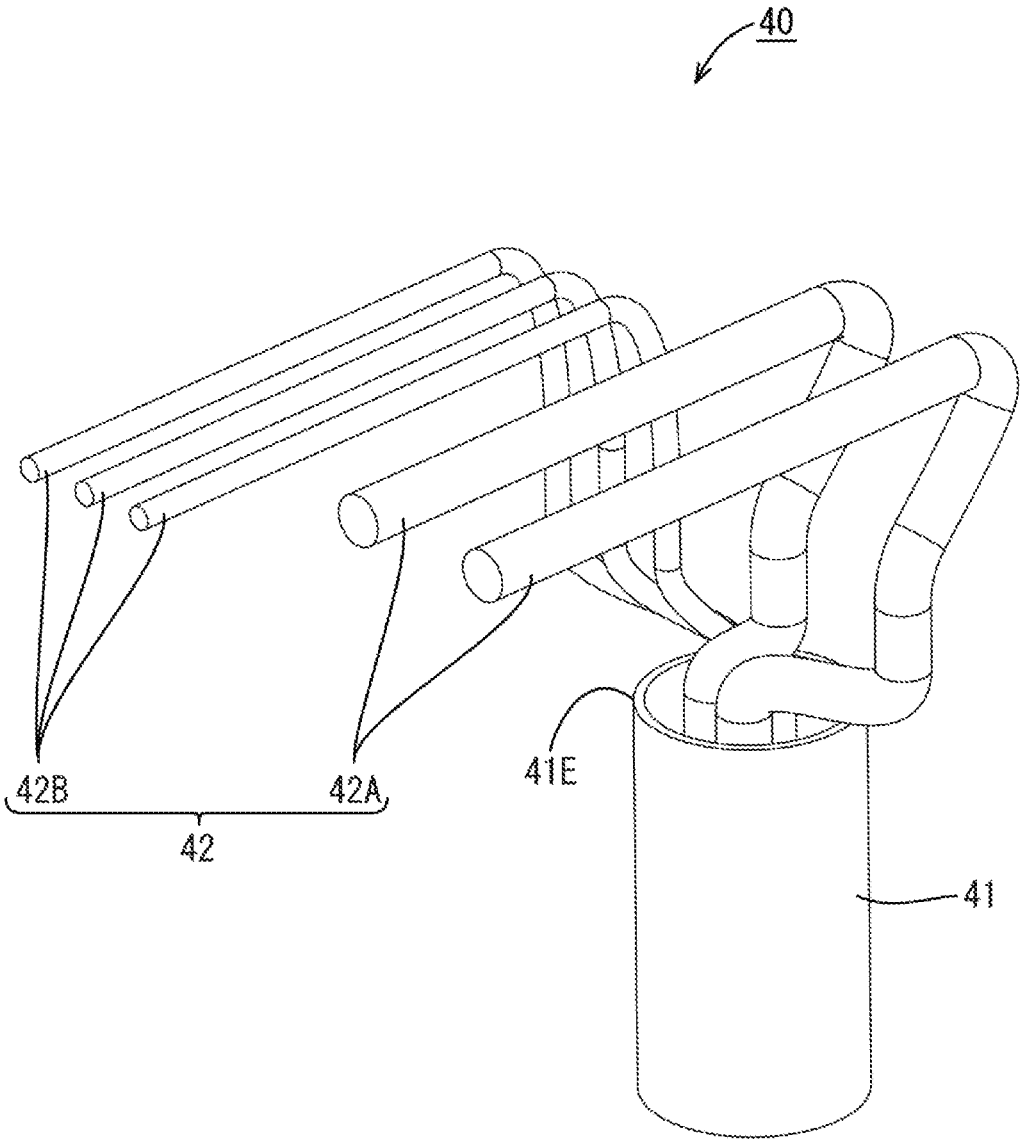
FIG. 5 is a perspective view illustrating a multicore cable.

As illustrated in FIG. 5, in the cable 40, a plurality (two in the present embodiment) of power wires 42A for power having a cross section with a substantially circular shape and a relatively large thickness, and a plurality (three in the present embodiment) of signal wires 42B for a signal having a smaller thickness than that of the power wire 42A are twisted with each other and collectively covered by the sheath 41. At the tip of the cable 40, the wires 42 are exposed from a tip portion 41E of the sheath 41 and untwisted. At a tip of each wire 42, the sheath is peeled off and a core is exposed. As illustrated in FIG. 1, a terminal T is connected to the exposed core by caulking and crimping. The terminal T is held in the terminal holding portion 12 of the connector housing 10 and the wire 42 extends outward from behind through an internal space of the wire surrounding portion 11.

Figure 6:
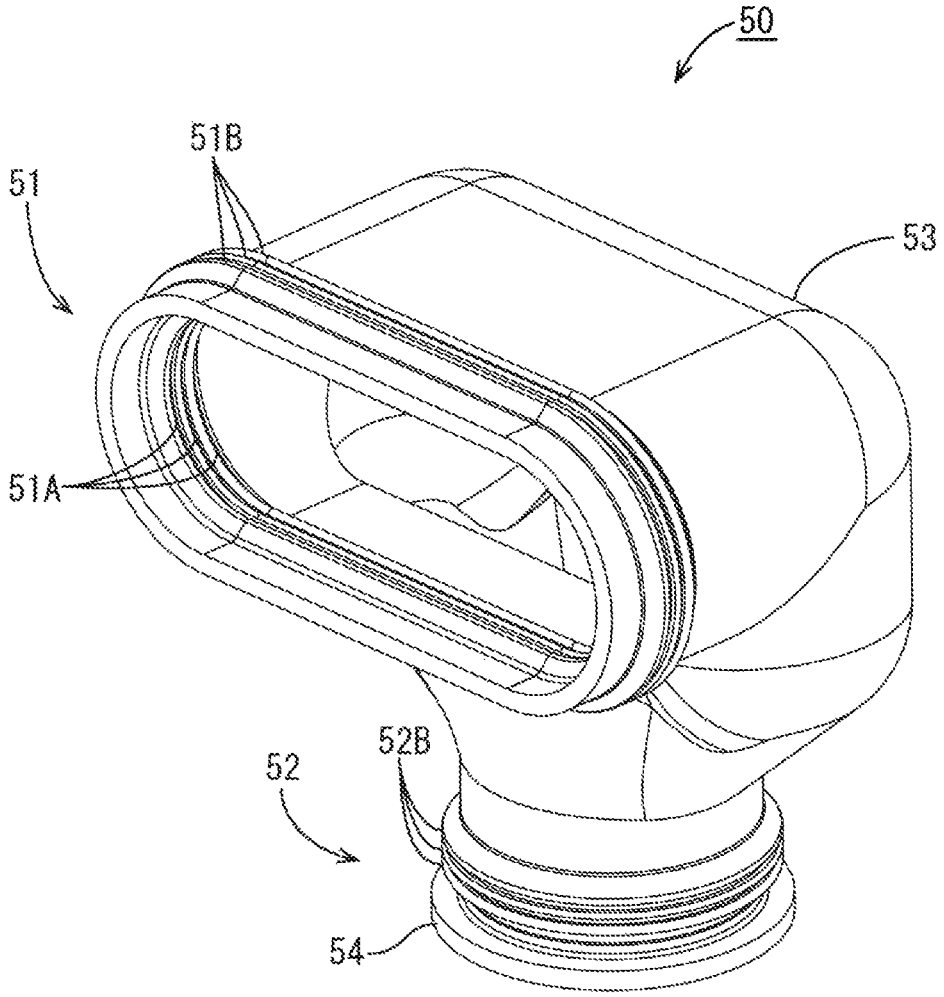
FIG. 6 is a perspective view illustrating a seal member.

The seal member 50 is formed of an elastic waterproof material such as a synthetic rubber or the like. As illustrated in FIG. 6, the seal member 50 is a hollow tubular body having a substantial L-letter shape when viewed from the side, in which a connector fitting portion 51 and a cable fitting portion 52 are continuously connected to each other over the whole circumference by a hollow seal main body portion 53 appropriately swelling outward, the connector fitting portion 51 having an oval cylinder shape and being open toward the front side and the cable fitting portion 52 having a cylindrical shape and being open toward the lower side.

In the connector fitting portion 51, a plurality (three in the present embodiment) of connector seal lip portions 51A are circumferentially provided on an inner circumferential surface of the connector fitting portion 51 over the whole circumference and a plurality (three in the present embodiment) of auxiliary connector seal portions 51B are circumferentially provided on an outer circumferential surface of the connector fitting portion 51 over the whole circumference. The connector seal lip portions 51A and the auxiliary connector seal portions 51B are, respectively, disposed at the same position in an axial direction of the connector fitting portion 51.

In the cable fitting portion 52, a plurality (three in the present embodiment) of cable seal lip portions 52A are circumferentially provided on an inner circumferential surface of the cable fitting portion 52 over the whole circumference and a plurality (three in the present embodiment) of auxiliary cable seal portions 52B are circumferentially provided on an outer circumferential surface of the cable fitting portion 52 over the whole circumference, as illustrated in FIGS. 1 and 6. The cable seal lip portions 52A and the auxiliary cable seal portions 52B are, respectively, disposed at the same position in an axial direction of the cable fitting portion 52. In the vicinity of an opening of the cable fitting portion 52, an edge lip portion 52C is circumferentially provided so as to face inward over the whole circumference and a positioning lip portion 54 is circumferentially provided so as to face outward over the whole circumference.

Figure 7:
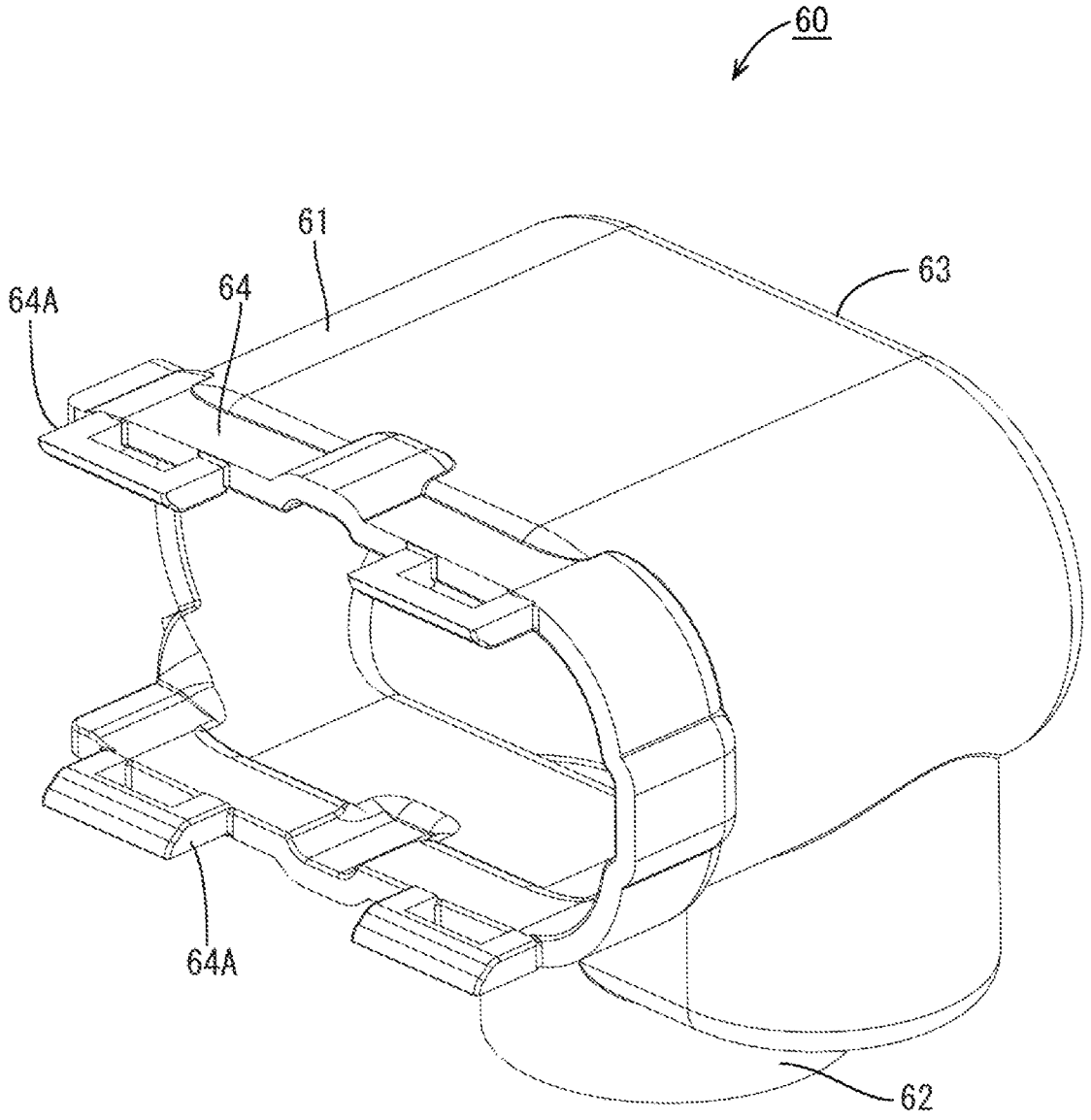
FIG. 7 is a perspective view illustrating a cover member.

The cover member 60 is formed of a relatively hard synthetic resin material. As illustrated in FIGS. 1 and 7, the cover member 60 is a hollow tubular body having a substantial L-letter shape overall when viewed from the side, in which a connector cover portion 61 and a cable cover portion 62 are continuously connected to each other over the whole circumference by a hollow cover main body portion 63, the connector cover portion 61 having an oval cylinder shape and being opened toward the front side and the cable cover portion 62 having a cylindrical shape and being opened toward the lower side.

A connector locking portion 64 extends to the front side from end portions of an upper surface and a lower surface of the connector cover portion 61 and the lock receiving portions 64A to be locked to the locking claws 15 of the connector housing 10 protrude from an end portion of the connector locking portion 64 to the front side.

Figure 3:
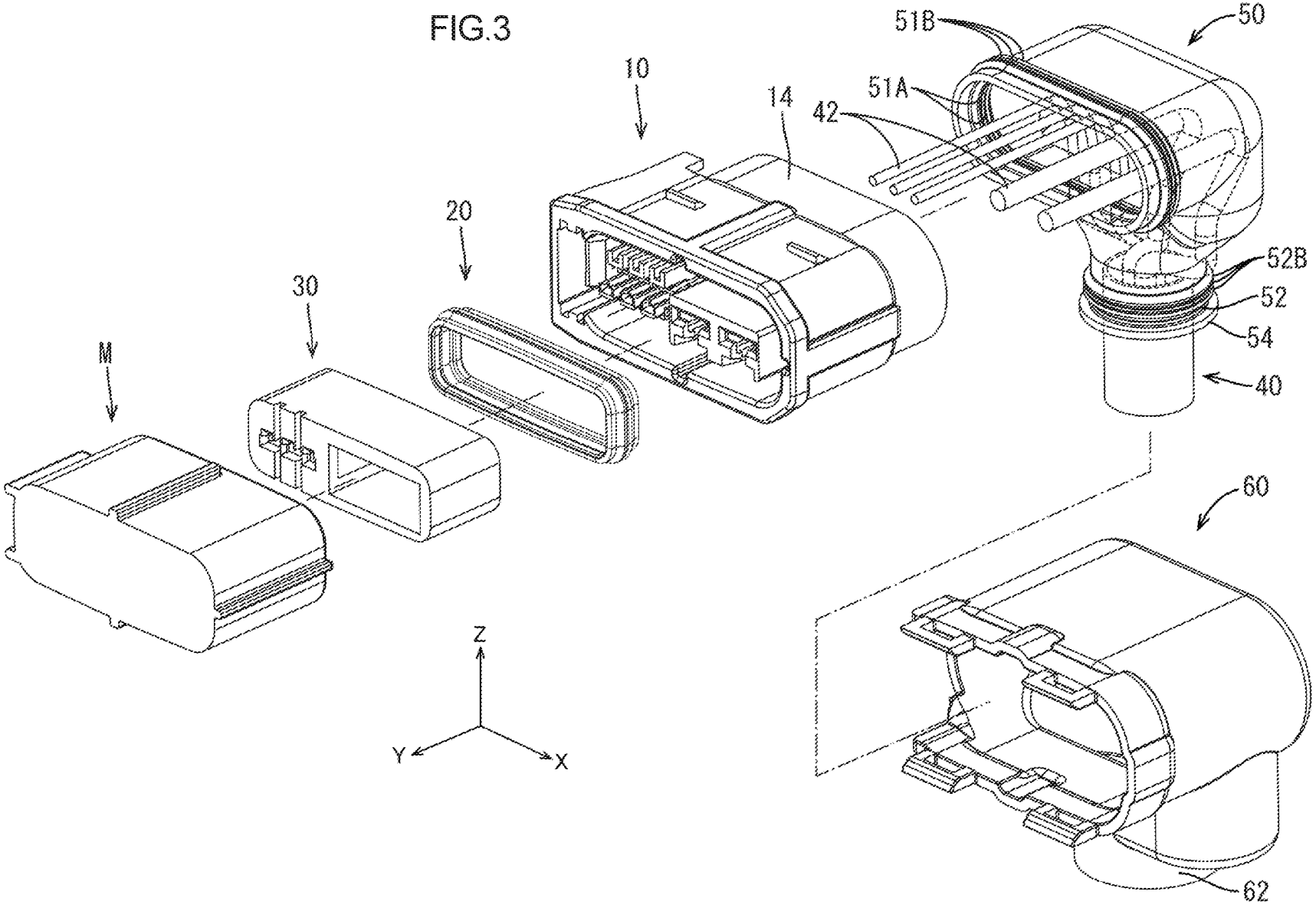
FIG. 3 is an exploded perspective view of the waterproof connector.
Figure 8:
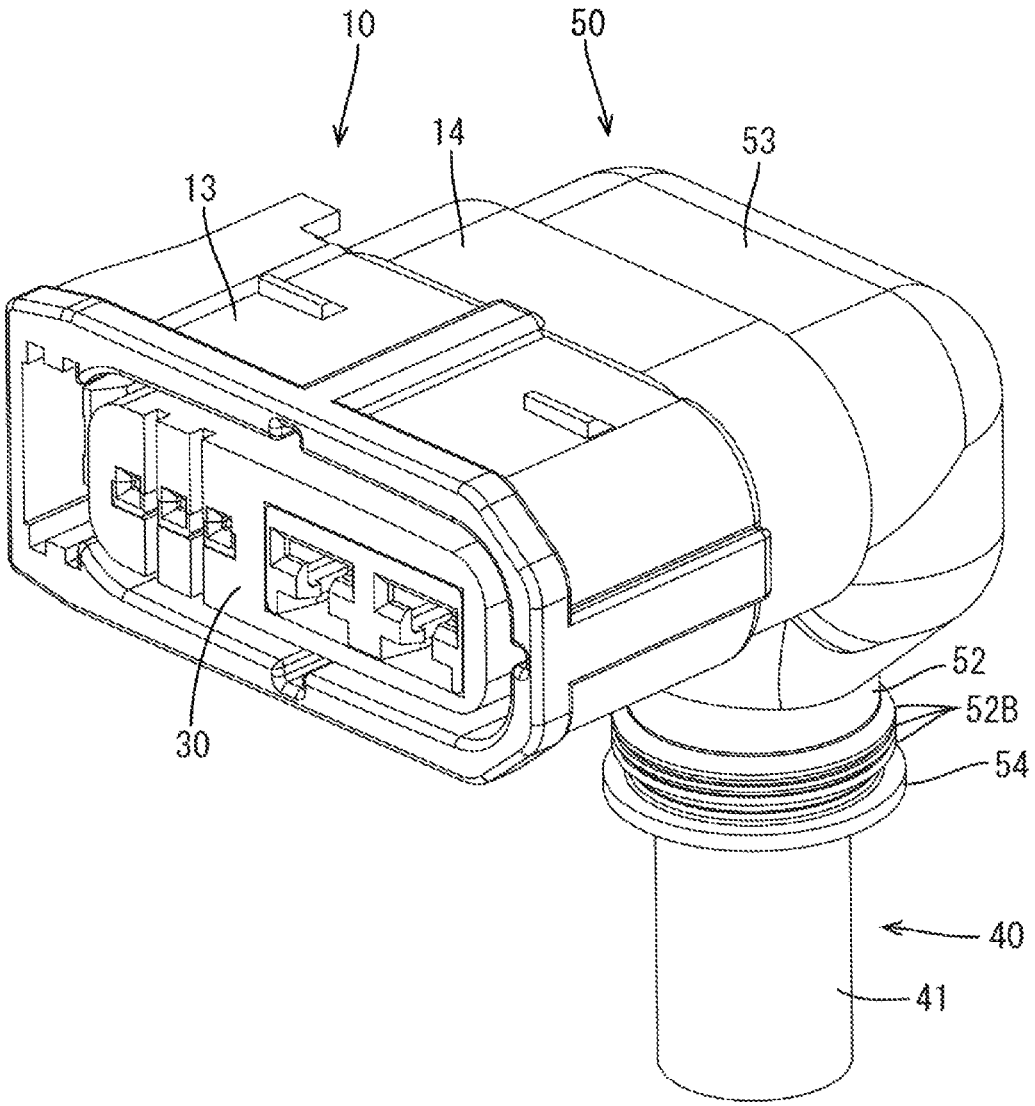

Next, an example of an assembling procedure of the connector 1 according to the present embodiment will be described with reference to FIGS. 3 and 8.

First, the cable 40, in which the terminals T are connected to the tips of the wires 42, is inserted into the cover member 60 from below, and then is inserted into the seal member 50 from below. Then, the respective terminals T are inserted into the inner cylinder portion 11A of the connector housing 10 and are inserted into and fixed to the respective terminal holding portions 12 at an inner side (front side) of the connector housing 10. Further, the connector fitting portion 51 of the seal member 50 is press-fitted into the gap between the inner cylinder portion 11A and the outer cylinder portion 14 of the connector housing 10, the connector seal lip portion 51A is fitted onto the outer circumferential surface of the inner cylinder portion 11A to closely adhere thereto over the whole circumference, the auxiliary connector seal portion 51B is fitted into the inner circumferential surface of the outer cylinder portion 14 to closely adhere thereto over the whole circumference, and the cable seal lip portion 52A and the edge lip portion 52C are fitted onto an outer circumferential surface of the sheath 41 in the vicinity of the tip portion 41E to closely adhere thereto over the whole circumference. Furthermore, the seal ring 20 and the front retainer 30 are sequentially fitted into the connector housing 10 through a front opening. By doing so, as illustrated in FIG. 8, the seal member 50 has opposite ends closely fitted into the connector housing 10 (the inner cylinder portion 11A of the wire surrounding portion 11) and onto the cable 40, respectively, over the whole circumference and forms a closed space with a front opening of the wire surrounding portion 11.

Next, the seal member 50 is pressed into the cover member 60 while being appropriately elastically deformed, the cable fitting portion 52 is press-fitted into the cable cover portion 62, the auxiliary cable seal portion 52B is fitted into an inner circumferential surface of the cable cover portion 62 to closely adhere thereto over the whole circumference, and the positioning lip portion 54 of the seal member 50 is exposed from a lower end of the cable cover portion 62 over the whole circumference. Then, the positioning lip portion 54 is elastically restored toward an outer side in a radial direction, and locked to an end surface of the cable cover portion 62.

Finally, the lock receiving portion 64A of the connector locking portion 64 is locked to the locking claw 15 of the connector housing 10 (hood portion 13). By doing so, the cover member 60 is fixed to the connector housing 10, thereby completing the connector according to the present embodiment.

Thereafter, a housing M of the counterpart connector is inserted into a gap between the hood portion 13 of the connector housing 10 and the front retainer 30 from the front and is fitted on the seal ring 20, the seal ring 20 being fitted on the outer circumferential surface of the front end portion 11B of the wire surrounding portion 11. By doing so, the front opening of the wire surrounding portion 11 is closed, thereby completing the waterproof structure of the connector 1.

Note that the assembling procedure of the connector 1 is not limited thereto. For example, the seal member 50 may be press-fitted into the cable cover portion 62 and then the wire 42 may be inserted thereinto. Alternatively, another easy procedure may be used according to various conditions such as a dimensional relation of each member or a degree of flexibility of the seal member 50.

According to the configuration described above, since it is only required that each wire 42 extends from the tip portion 41E of the sheath 41 into the seal member 50 in any posture (at any angle) while having any arrangement relation, an assembling operation becomes easy. Furthermore, since the sealed portion (in the vicinity of the sheath tip portion 41E) is linearly fixed by the relatively hard cover portion, it is possible to suppress an influence of bending of other portions of the wire 42, thereby making it possible to decrease a length from the bent portion.

Further, since the seal member is not interposed between the respective wires 42, it is possible to decrease a diameter dimension of the connector 1.

In addition, since the wire 42 disposed between the sheath tip portion 41E and the connector housing 10 is waterproofed with the seal member 50, it is possible to prevent an electric leakage from the wire 42 or an intrusion of water into the sheath of the wire 42 even in a case where the sheath of the wire 42 is damaged.

Embodiment 2

Figure 9:
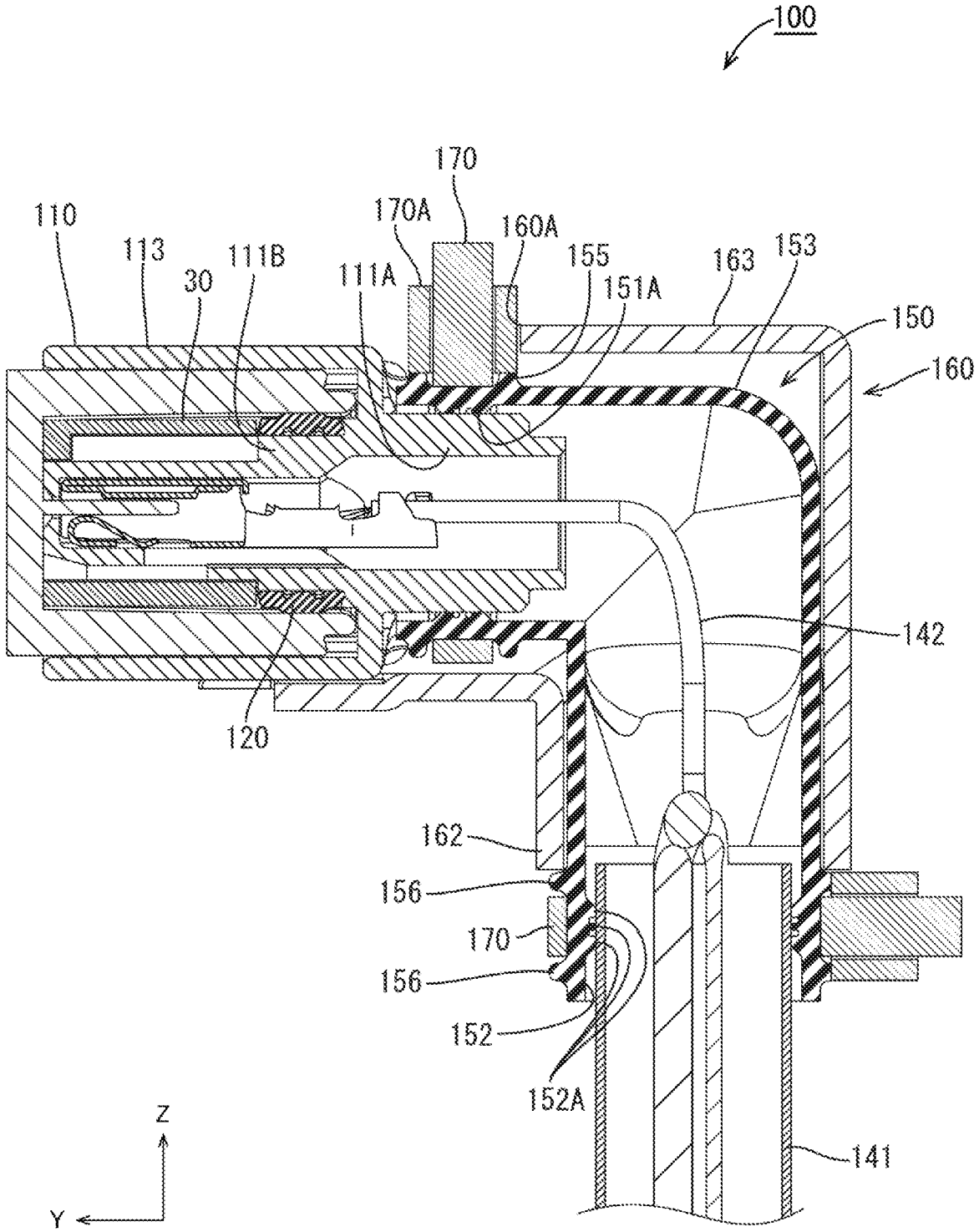
FIG. 9 is a cross-sectional view of a waterproof connector according to Embodiment 2.
Figure 10:
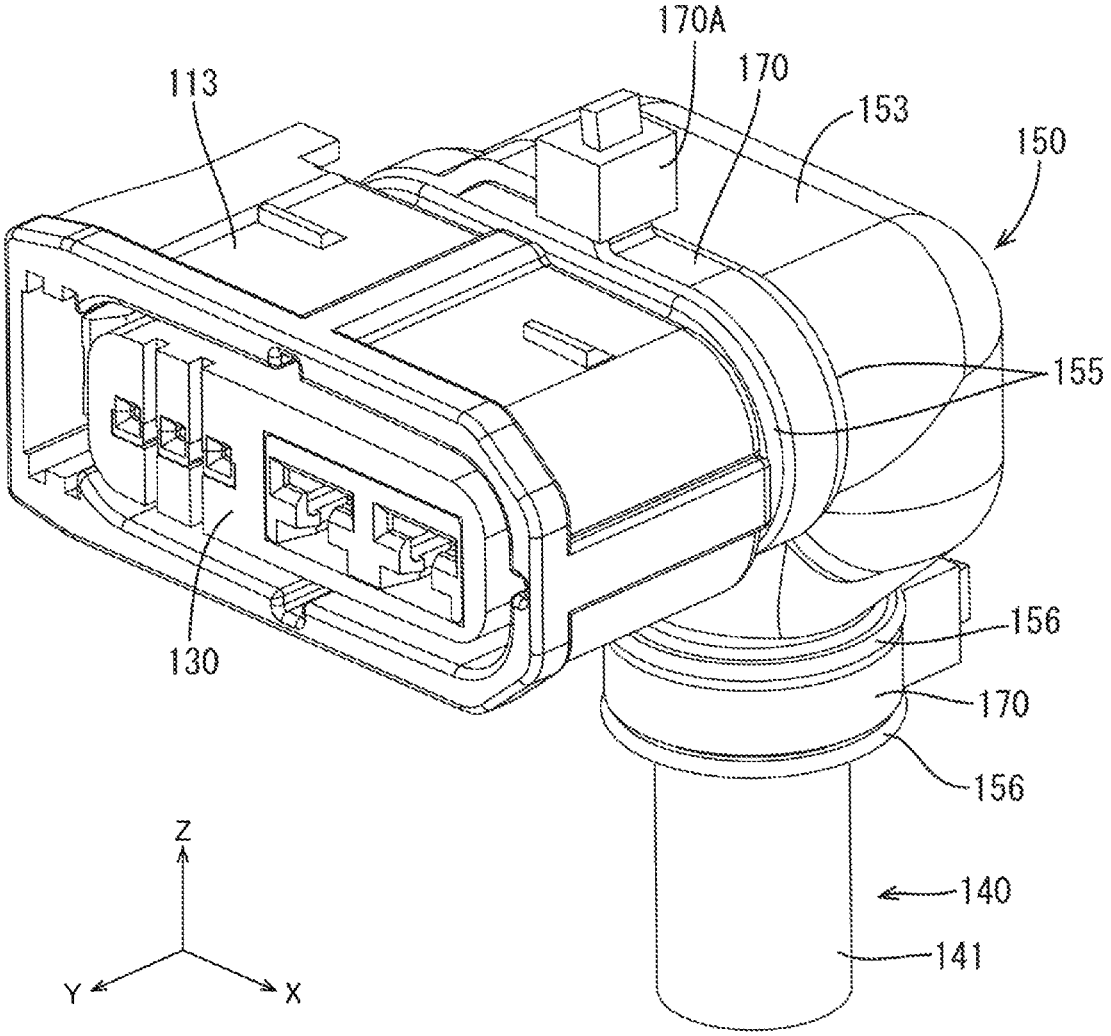
FIG. 10 is a perspective view of the waterproof connector according to Embodiment 2.

Next, Embodiment 2 of the technology disclosed in the present description will be described with reference to FIGS. 9 and 10.

Unlike Embodiment 1, in a connector 100 of the present embodiment, an outer cylinder portion 14 in a connector housing 110 is omitted and two first tie band positioning protrusions 155 are circumferentially provided on a seal member 150 over the whole circumference, instead of an auxiliary connector seal portion 51B. Further, a tie band 170 is disposed between the two first tie band positioning protrusions 155 for fastening to increase adhesion of a connector fitting portion 151 with respect to an inner cylinder portion 111A of a wire surrounding portion 111. The cover member 160 is provided with a tie band disturbance preventing portion 160A at substantially the center of a front end portion of an upper surface thereof, such that a tie band fastening portion 170A is not disturbed when the cover member 160 is fitted onto the connector housing 110.

Furthermore, two second tie band positioning protrusions 156 are circumferentially provided on a cable fitting portion 152 of the seal member 150 over the whole circumference, instead of an auxiliary cable seal portion 52B, and are exposed from a lower end portion of a cable cover portion 162. Further, a tie band 170 is disposed between the two second tie band positioning protrusions 156 for fastening to increase adhesion of the cable fitting portion 152 with respect to a sheath 141 of a cable 140. Note that other components are the same as those of Embodiment 1 and thus a description thereof will be omitted.

According to the configuration, since the tie band 170 fastens the seal member 150 after the seal member 150 is fitted onto the connector housing 110 and the cable 140 (in other words, the fitting and the enhancement of the adhesion are performed separately), the fitted state before and after the fastening with the tie band 170 can be visually inspected. In addition, since certain fastening is enabled by the tie band 170, it is possible to cause the seal member 150 to more appropriately adhere to the connector housing 110 and the cable 140.

The technology disclosed in the present description is not limited to the embodiments described above with reference to the description and the drawings, and, for example, the following embodiments also fall within the scope of the technology disclosed in the present description.

Figure 11:
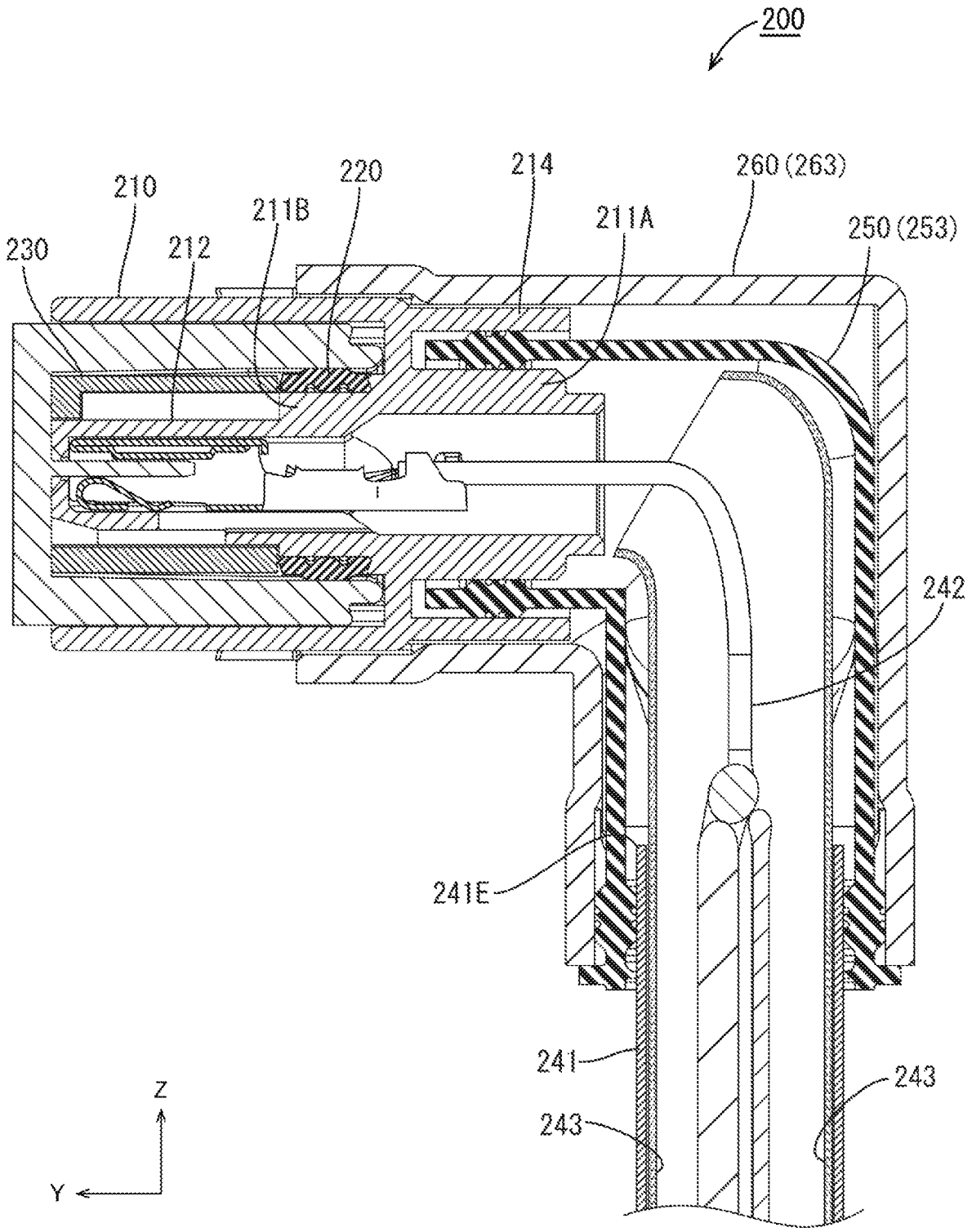
FIG. 11 is a cross-sectional view of a waterproof connector according to another embodiment.

In the embodiments described above, the cable 40 or 140 in which a plurality of wires having thicknesses different from each other are collectively covered with a sheath is used, but the multicore cable is not limited thereto. For example, a cabtire cable in which a wire is embedded in an outer sheath may be used. Alternatively, for example, a braided wire 243 for electromagnetic shielding, which collectively surrounds a plurality of wires 242, may be disposed inside a sheath 241. In this case, it is possible to allow the braided wire to extend from a tip 241E of the sheath 241 to an internal space of a seal member 250 as illustrated in FIG. 11 by using a configuration in which an inside of the sheath 241 communicates with the internal space of the seal member 250. By doing so, the braided wire 243 itself can be isolated from water or the like and at the same time, the wires 242 extending from the sheath 241 can be shielded. This configuration is suitable for, particularly, a case where a connector 200 cannot but be disposed adjacent to a device which is a noise source, or a case where a wire which is a noise source is included in a cable.

In the embodiments described above, the seal member 50 or 150 covers from the sheath tip portion 41E or 141E up to the connector housing 10 or 110, and the cover member 60 or 160 covers the seal member 50 or 150. However, the present invention is not limited thereto. For example, in a case where a sufficient adhesion can be obtained by an elastic force of the cable fitting portion 52, the cable cover portion 62 may be omitted, and in a case where the seal member 50 has a strength enough to endure an external impact, the cover main body portion 63 may be omitted.

In the embodiments described above, the seal lip portions 51A or 151A, and 52A or 152A are provided on the inner circumferential surfaces of the connector fitting portion 51 or 151, and the cable fitting portion 52 or 152. However, for example, in a case where a sufficient adhesion can be obtained without the seal lip portion 51A or 151A, the seal lip portion 51A or 151A may be omitted.

In the embodiments described above, the seal member 50 or 150 and the cover member 60 or 160 each have a substantial L-letter shape from the connector housing 10 or 110 to the sheath tip portion 41E or 141E. However, the seal member 50 or 150 and the cover member 60 or 160 may be bent to have, for example, a substantial U-letter shape by further increasing a bending degree as necessary, or may have a straight line shape without a bent portion.

EXPLANATION OF SYMBOLS

1: Connector
10: Connector housing
11B: Front end portion
11A: Inner cylinder portion
14: Outer cylinder portion
40: Cable
41: Sheath
41E: Tip portion
42: Wire
50: Seal member
53: Seal main body portion
51A: Connector seal lip portion
51B: Auxiliary connector seal portion
52A: Cable seal lip portion
52B: Auxiliary cable seal portion
60: Cover member
62: Cable cover portion
63: Cover main body portion

The invention claimed is:

1. A waterproof structure of a connector, the waterproof structure comprising:

a multicore cable including wires and an outer sheath surrounding the wires, each of the wires having an exposed portion exposed from the outer sheath and extending from the tip portion of the outer sheath with any arrangement relation, the exposed portion of each of the wires having a tip;

a connector main body connected to the extending portions of wires; and a waterproof member collectively covering the extending portions of the wires between the outer sheath of the multicore cable and the connector main body and in which the wires extend with any arrangement relation, the waterproof member including a first end fitted to the tip portion of the outer sheath and a second end fitted to the connector main body, wherein:

the connector main body includes an inner cylinder portion into which the wires are inserted; and the waterproof member includes a connector fitting portion provided at the second end of the waterproof member, the connector fitting portion including a connector seal lip portion circumferentially provided on an inner circumferential surface of the connector fitting portion, the connector seal lip portion being fit onto the inner cylinder portion of the connector main body.

2. The waterproof structure of a connector according to claim 1, comprising:

a hard cover member disposed to surround the waterproof member;

wherein the waterproof member includes a cable fitting portion provided at the first end of the waterproof member, the cable fitting portion including: a cable seal lip portion circumferentially provided on an inner circumferential surface of the cable fitting portion and fit onto the outer sheath, and an auxiliary cable seal portion fitted into the cover member is circumferentially provided on an outer circumferential surface of the cable fitting portion and fit into the cover member, wherein the cable seal lip portion and the auxiliary cable seal portion are disposed at a same position in an axial direction of the cable fitting portion.

3. The waterproof structure of a connector according to claim 1, wherein:

the connector main body further includes an outer cylinder portion disposed to surround the inner cylinder portion, the connector fitting portion includes an auxiliary connector seal portion circumferentially provided on an outer circumferential surface of the connector fitting portion and fit into the outer cylinder portion, the connector seal lip portion and the auxiliary connector seal portion being disposed at a same position in an axial direction of the connector fitting portion.

4. The waterproof structure of a connector according to claim 1, wherein the wires include a power wire and a signal wire thinner than the power wire, and the power wire and the signal wire are bent between the tip portion of the outer sheath and the connector main body.

5. The waterproof structure of a connector according to claim 1, wherein the multicore cable includes a braided wire collectively surrounding the wires in the outer sheath, and the braided wire extends from the tip portion of the outer sheath toward the connector main body.

6. The waterproof structure of a connector according to claim 1, wherein the waterproof member is formed of an elastic waterproof material.

7. The waterproof structure of a connector according to claim 1, wherein the waterproof member has a tubular shape and forms a closed space between the multicore cable and the connector main body.

8. The waterproof structure of a connector according to claim 1, wherein the second end of the waterproof member defines a single tubular opening that is fit to the connector main body.

9. The waterproof structure of a connector according to claim 1, wherein the second end of the waterproof member has an inner surface spaced outward from the wires.

10. A waterproof structure of a connector, the waterproof structure comprising:

a multicore cable including wires and an outer sheath surrounding the wires, each of the wires having an exposed portion exposed from the outer sheath and extending from the tip portion of the outer sheath with any arrangement relation, the exposed portion of each of the wires having a tip;

a connector main body connected to the extending portions of wires, the connector main body including an inner cylinder portion into which the wires are inserted, a waterproof member collectively covering the extending portions of the wires between the outer sheath of the multicore cable and the connector main body and in which the wires extend with any arrangement relation, the waterproof member including a first end fitted to the tip portion of the outer sheath and a second end fitted to the connector main body, a cable fitting portion provided at the first end of the waterproof member, the cable fitting portion including: a cable seal lip portion circumferentially provided on an inner circumferential surface of the cable fitting portion and fit onto the outer sheath; and an auxiliary cable seal portion circumferentially provided on an outer circumferential surface of the cable fitting portion, the cable seal lip portion and the auxiliary cable seal portion being disposed at a same position in an axial direction of the cable fitting portion, a connector fitting portion provided at the second end of the waterproof member, the connector fitting portion including a connector seal lip portion circumferentially provided on an inner circumferential surface of the connector fitting portion, the connector seal lip portion being fit onto the inner cylinder portion of the connector main body; and a hard cover member disposed to surround the waterproof member, the auxiliary cable seal portion being fit into the hard cover member.

11. The waterproof structure of a connector according to claim 10, wherein:

the connector main body further includes an outer cylinder portion disposed to surround the inner cylinder portion, the connector fitting portion includes an auxiliary connector seal portion circumferentially provided on an outer circumferential surface of the connector fitting portion and fit into the outer cylinder portion, the connector seal lip portion and the auxiliary connector seal portion being disposed at a same position in an axial direction of the connector fitting portion.

12. The waterproof structure of a connector according to claim 11, wherein the wires include a power wire and a signal wire thinner than the power wire, and the power wire and the signal wire are bent between the tip portion of the outer sheath and the connector main body.

13. The waterproof structure of a connector according to claim 12, wherein the multicore cable includes a braided wire collectively surrounding the wires in the outer sheath, and the braided wire extends from the tip portion of the outer sheath toward the connector main body.

* * * * *